US006857474B2

(12) United States Patent
Bramlett et al.

(10) Patent No.: US 6,857,474 B2
(45) Date of Patent: Feb. 22, 2005

(54) METHODS, APPARATUS AND PRODUCTS USEFUL IN THE OPERATION OF A SUCKER ROD PUMP DURING THE PRODUCTION OF HYDROCARBONS

(75) Inventors: Bobby R. Bramlett, Houston, TX (US); Doneil M. Dorado, Houston, TX (US); Sam Gavin Gibbs, Midland, TX (US); Kenneth Bernard Nolen, Midland, TX (US); LeMoyne Boyer, Midland, TX (US)

(73) Assignee: Lufkin Industries, Inc., Houston, TX (US)

( * ) Notice: Subject to any disclaimer, the term of this patent is extended or adjusted under 35 U.S.C. 154(b) by 108 days.

(21) Appl. No.: 09/970,041

(22) Filed: Oct. 2, 2001

(65) Prior Publication Data

US 2003/0065447 A1 Apr. 3, 2003

(51) Int. Cl.[7] ..... E21B 47/00; E21B 43/00

(52) U.S. Cl. ..... 166/250.15; 166/53; 166/66; 166/68.5; 73/152.61; 417/63

(58) Field of Search ..... 417/63, 18, 53; 73/152.61, 152.62; 166/250.15, 53, 68.5, 66

(56) References Cited

U.S. PATENT DOCUMENTS

| | | | | | |
|---|---|---|---|---|---|
| 3,951,209 | A | * | 4/1976 | Gibbs | 166/250.15 |
| 4,015,469 | A | * | 4/1977 | Womack et al. | 73/152.61 |
| 4,490,094 | A | * | 12/1984 | Gibbs | 417/42 |
| 4,541,274 | A | * | 9/1985 | Purcupile | 73/152.61 |
| 4,594,665 | A | * | 6/1986 | Chandra et al. | 702/6 |
| 5,064,349 | A | * | 11/1991 | Turner et al. | 417/53 |
| 5,252,031 | A | * | 10/1993 | Gibbs | 417/53 |
| 5,406,482 | A | * | 4/1995 | McCoy et al. | 702/6 |
| 5,464,058 | A | * | 11/1995 | McCoy et al. | 166/250.01 |
| 5,589,633 | A | * | 12/1996 | McCoy et al. | 417/63 |
| 5,678,981 | A | * | 10/1997 | Dunham | 417/18 |
| 6,343,656 | B1 | * | 2/2002 | Vazquez et al. | 166/373 |

* cited by examiner

*Primary Examiner*—Hoang Dang
(74) *Attorney, Agent, or Firm*—Gary L. Bush; Andrews Kurth LLP

(57) ABSTRACT

Apparatus, methods and products for monitoring/controlling a reciprocating well producing hydrocarbons from a wellbore, which determine the surface card from a well operating characteristics, determine the downhole card, and display both at the same scale for position.

39 Claims, 5 Drawing Sheets

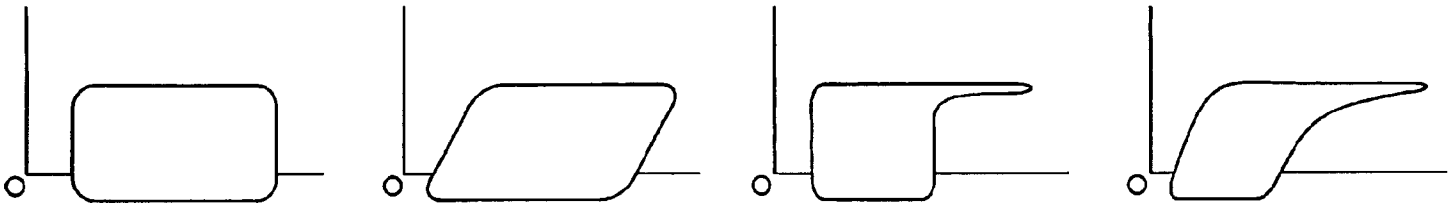
FULL PUMP
FIG. 5A
TUBING MOVEMENT
FIG. 5B
FLUID POUND
FIG. 5C
GAS INTERFERENCE
FIG. 5D
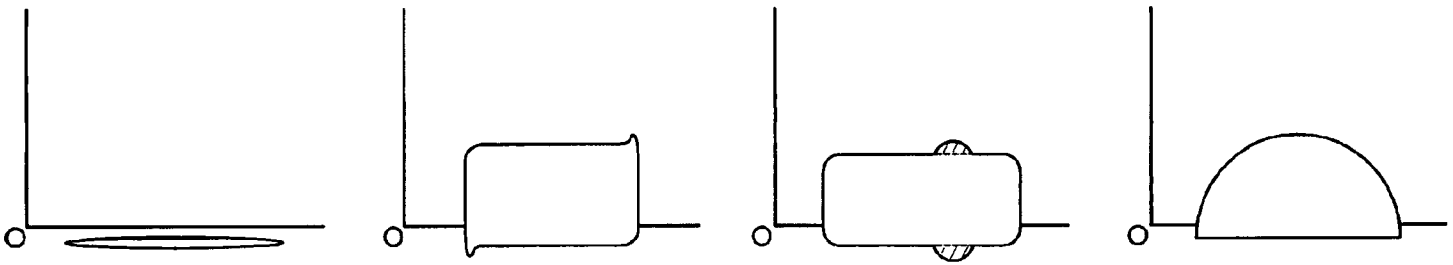
FLOWING WELL, ROD PART, INOPERATIVE PUMP
FIG. 5E
PUMP HITTING UP OR DOWN
FIG. 5F
BENT BARREL OR STICKING PUMP
FIG. 5G
WORN PLUNGER OR TRAVELING VALVE
FIG. 5H
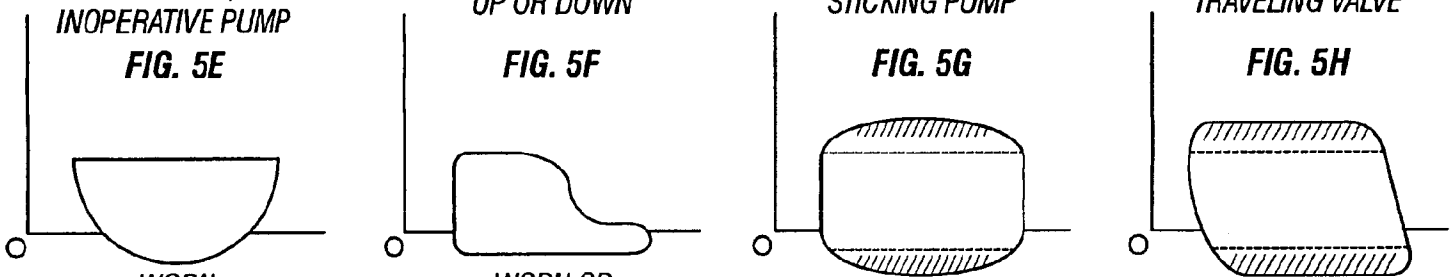
WORN STANDING VALVE
FIG. 5I
WORN OR SPLIT BARREL
FIG. 5J
FLUID FRICTION
FIG. 5K
DRAG FRICTION
FIG. 5L

METHODS, APPARATUS AND PRODUCTS USEFUL IN THE OPERATION OF A SUCKER ROD PUMP DURING THE PRODUCTION OF HYDROCARBONS

BACKGROUND OF THE INVENTION

1. Field of the Invention

The present invention relates to apparatus, methods and products for the production of hydrocarbons. In another aspect, the present invention relates to methods, apparatus and products for the production of hydrocarbons with sucker rod pumps. In even another aspect, the present invention relates to methods, apparatus and products useful in the operation of a sucker rod pump during the production of hydrocarbons.

2. Description of the Related Art

Hydrocarbons are often produced from wellbores by sucker rod pumps.

These "sucker rod" pumps are reciprocating pumps driven from the surface by pumping units that move a polished rod up and down through a packing gland at a wellhead. The unit may be of the predominant beam type or any other type that reciprocates the polished rod. For example, a beam pumping unit utilizes a walking beam pivotally mounted on a Samson post with one end of the beam being attached to the rod and with the beam being reciprocated by a drive unit. The drive unit consists of a prime mover connected to a reduction unit that drives a crank to reciprocate the walking beam.

The polished rod extends, via a sucker rod string, to a cylinder above, below, or in a portion of an oil producing strata. The sucker rod string is connected to a downhole pump. This downhole pump generally includes a plunger within the cylinder, the plunger including a checkvalve allowing liquids to pass upward through the valve but not downward. This check valve is referred to as a traveling valve. A second check valve is located at the bottom the cylinder that allows liquids to enter the cylinder but not leave the cylinder in the downward direction. The second check valve is referred to as a standing valve. Raising the polished rod therefore lifts the plunger, draws liquids into the cylinder through the standing valve, and lifts the cylinder contents above the plunger up through a tubing string toward the surface. The down stroke of the polished rod lowers the plunger, allowing the contents of the cylinder below the traveling valve to pass through the valve to above the traveling valve.

While sucker rod pumps are relatively simple units, they are generally expensive to provide and maintain.

Repair of seals around the plunger, standing valve, or traveling valve require lifting of the entire down-hole unit by the sucker rod or tubing string to the surface. It is not unusual to have a mile or more of sucker rods or tubing that must be lifted and disassembled by one or two twenty five or thirty foot long sections at a time. This repair is costly in terms of repair labor and parts cost, and in the terms of lost revenue from the well.

Power requirements of the sucker rod pump are also not insignificant, and are greatly effected by the efficiency at which the unit is operating.

Because the marginal additional cost of a larger sucker rod pump is negligible compared to the time value of money realized by producing oil from the well at a faster rate, sucker rod pumping units are typically designed to pump slightly more than the well can produce. Consequently, sucker rod pumps therefore eventually run out of liquids to pump, and draw gas into the cylinders through the standing valves, a condition known as running pumped off.

This term "pumped-off" is used to describe the condition where the fluid level in the well is not sufficient to completely fill the pump barrel on the upstroke. On the next downstroke the plunger will impact the fluid in the incompletely filled barrel and send shock waves through the rod string and other components of the pumping system. This can cause harm to the pumping system such as broken rods or damage to the drive unit or downhole pump.

To minimize running pumped off, sucker rod pumps are generally operated with some type of controller. These controllers are either simple controllers designed not to detect a pump off condition, but rather to avoid an estimated pump off condition, or are more sophisticated pump-off controllers designed to detect when a well pumps off and to shut the well down.

An example of these simple controllers are clock timers that start and stop the pumping unit in response to a set program designed to avoid a pump off condition. For example, if 2 hours of pumping results in a pumped off condition, and it will take 5 hours for sufficient fluid to enter the casing, then the time clock would run the pump for 2 hours (or slightly less to be conservative), and then shut the pump off for 5 hours (or slightly more to be conservative), with 2 hour on/5 hour off cycle continuing until conditions warranted a change. Unfortunately, these simple clock timers are not responsive to changing conditions, such as changes in the reservoir, or the occurrence of abnormal operating conditions. Such a changing condition may occur, with the timer continuing its on/off cycle until human intervention (which may be long after damage to the pump has occurred).

These abnormal conditions of sucker rod pump operation can also be detrimental to the pump, and the well efficiency, and many of these abnormal conditions can be detected by accurate monitoring of the pump operation. For example, a few of the abnormal conditions include, running pumped off, tubing movement, fluid pound, gas interference, inoperative pump, pump hitting up or down, bent barrel, sticking pump, worn plunger or traveling valve, worn standing valve, worn or split barrel, fluid friction, and drag friction. As many of these problems gradually appear and progressively worsen, early detection of these problems can often minimize the cost of maintenance, minimize the cost of inefficient operation, and prevent or minimize the loss of production.

As could be guessed, numerous methods have therefore been proposed to monitor and control sucker rod pump operation.

An example of the more sophisticated pump-off controllers designed to detect when a well pumps off and to shut the well down, include the very common commercially available controllers that monitor work performed, or something that relates to work performed, as a function of polish rod position. This information can be used to determine, for example, if the liquids are pumped off, or if valves are leaking or stuck, and can provide data useful in trouble shooting a wide variety of other problems.

This information is generally presented in the form of a plot (as both are measured at the surface) of load vs. rod string displacement (or position) on the rod string. For a normally operating pump, the shape of this plot (known as a "surface card"), is generally an irregular football shape. The area inside of this rectangle is proportional to the work being performed. Many pump off controllers utilize a plot such as this to determine when the sucker rod pump is pumped off, and then shutdown the pump for a time period when a criteria indicating the pump is not filling. Criteria that have been suggested include load at a fixed position in the downstroke, maximum load, and area inside of the rectangle (often referred to as the surface card area).

The following are but a few of the many patents in this area of utilizing a surface card for control of a sucker rod pump.

For example, U.S. Pat. No. 3,951,209, issued Apr. 20, 1976 to Gibbs, describes a controller that measures at the surface both the load on the rod string and the displacement of the rod string. From these measurements, one can obtain a surface card and the area of the card will be the power input to the rod string. Since the pumping system will be lifting less fluid when the well pumps off, the power input to the rod string will also decrease. The decrease in power will result in a decrease in the area of the surface dynamometer card. This decrease in area is used as an indication of a pump-off condition and the pumping unit is shut down.

U.S. Pat. Nos. 5,006,044, 5,362,206 and 5,372,482 disclose methods to monitor electric motor power consumption as an indicator of work being performed by the sucker rod pump.

U.S. Pat. Nos. 5,224,834, 5,237,863, 5,252,031, and 5,314,016 disclose various method to monitor and control sucker rod pumps using a strain gauge either located on the polish rod or on the beam of a beam pumping unit as an indicator of load. A common shortcoming of the beam-mounted strain gauges is the inability of the strain gauges to differentiate between strain caused by load on the beam or metal and strain caused by changing temperature of the metal. This problem is particularly noticeable when the strain gauge is mounted on the beam rather than the polish rod. The beam is otherwise a convenient place to mount the strain gauge for reasons that include less movement of the conduits to the gauge, and less need to remove the gauge when maintenance is performed on the pumping unit. The apparent load of the plot of load vs. position will therefore change due to variables such as temperature.

U.S. Pat. Nos. 4,583,915 and 5,423,224 suggest apparatus and methods to temperature compensate strain gauge measurements for changes in temperature. Both of these patents suggest methods that essentially zero-out changes in a measured parameter over a long time period so that slow drifts will be compensated out of the strain gauge output, whereas major changes will not immediately be compensated out, thus permitting the monitoring and control system to function without significant drift due to temperature changes. Because these systems eventually zero out all changes, the absolute level of load is never known, and even the load relative to a datum is not known. Further, these methods generally select one load measurement to hold constant. The maximum load, minimum load, and average load have all been used, and each has disadvantages. Generally, the maximum load will vary at the start of a pump off cycle, but be more consistent near the end of the cycle. The end of the pump off cycle is when it is most important to have reliable information to know if criteria for shutting down the pump is reached, but it would also be desirable to have accurate load compensation at the beginning of the pump cycle.

U.S. Pat. No. 3,306,210 discloses a pump-off controller that monitors the load on the polished rod at a set position in the downstroke. Pump-off is detected when the load exceeds a preset level at that set position. U.S. Pat. No. 4,583,915 discloses a pump-off controller that monitors an area outside the surface dynamometer card. More particularly, the patent discloses monitoring an area between the minimum load line and the load line at the top of the stroke. Other pump-off controllers have monitored the electrical current drawn by the drive motor to detect pump-off.

U.S. Pat. No. 4,490,094 discloses a pump-off controller that monitors the instantaneous speed of revolution of the drive motor during a complete or portion of the cycle of the pumping unit. Pump off is sensed by calculating a motor power from measured speed which is less than the motor power corresponding to a completely filled pump barrel. Both the surface load and position of the rod string can also be determined from the monitored instantaneous speed of the drive motor.

A major disadvantage of all of these "surface card" methods, is that the surface card is not always an accurate representation of the downhole rod string displacement (or position) and the downhole load on the rod string. Use of the surface card introduces errors caused by ambiguities in the surface card, the obscuring effects of downhole friction along the rods, as well as numerous other factors.

A more accurate representation, would be to utilize a "downhole card," that is, a plot (as both are measured downhole) of load vs. rod string displacement (or position). As these measurements are not possible to easily obtain, methods exist to estimate this downhole card.

For example, U.S. Pat. No. 5,252,031 utilizes the surface determination of load and displacement of the rod string (by monitoring the position of the crank arm that reciprocates the walking beam) to calculate the downhole card.

As another example, U.S. Pat. No. 5,406,482, discloses the use of an accelerometer in the calculation of the downhole pump card.

The downhole pump card can also be obtained using other methods including the method described in U.S. Pat. No. 3,343,409, which utilizes surface measurements of load and position of the rod string to construct a downhole pump card. The downhole card is obtained by the use of a computer to solve a mathematical expression described in the patent.

Of course, an alternative is to construct an analog circuit of the pumping system. It will be appreciated that while an analog circuit provides an instantaneous downhole card, it is unique to the particular pumping system, and would have to be extremely sophisticated to account for any changes in the system.

However, in spite of the above advancements, there still exists a need in the art for apparatus, methods, and products for monitoring and/or operating a reciprocating well.

There is another need in the art for apparatus, methods, and products for monitoring and/or operating a reciprocating well, which do not suffer from the disadvantages of the prior art apparatus and methods.

There is even another need in the art for apparatus, methods, and products for monitoring and/or operating a reciprocating well, which provide for near real time generation of a downhole card.

There is still another need in the art for apparatus, methods, and products for monitoring and/or operating a reciprocating well, which allow for the concurrent viewing of the surface card and the downhole card.

There is yet another need in the art for apparatus, methods, and products for monitoring and/or operating a reciprocating well, which provide graphical representation of the surface card and the downhole card in which the viewable graphical representation, the axis on the surface card representing position is at the same scale as the axis on the downhole card representing position.

There is even still another need in the art for apparatus, methods, and products for monitoring and/or operating a reciprocating well, which utilize surface card data and/or downhole card data in the operation of the well.

These and other needs in the art will become apparent to those of skill in the art upon review of this specification, including its drawings and claims.

SUMMARY OF THE INVENTION

It is an object of the present invention to provide for apparatus, methods, and products for monitoring and/or operating a reciprocating well, which do not suffer from the disadvantages of the prior art apparatus and methods.

It is another object of the present invention to provide for monitoring and/or operating a reciprocating well, which provide for near real time generation of a downhole card.

It is even another object of the present invention to provide for apparatus, methods, and products for monitoring and/or operating a reciprocating well, which allow for the concurrent viewing of the surface card and the downhole card.

It is still another object of the present invention to provide for monitoring and/or operating a reciprocating well, which provide graphical representation of the surface card and the downhole card in which the viewable graphical representation, the axis on the surface card representing position is at the same scale as the axis on the downhole card representing position.

It is yet another object of the present invention to provide for monitoring and/or operating a reciprocating well, which utilize surface card data and/or downhole card data in the operation of the well.

These and other objects of the present invention will become apparent to those of skill in the art upon review of this specification, including its drawings and claims.

According to one embodiment of the present invention, there is provided a system for monitoring a reciprocating pump producing hydrocarbons from a wellbore extending from the surface into the subterranean. The system generally includes a data gathering system to monitor a surface operating characteristic of the pumping system. The system also includes a processor in communication with the data gathering system, wherein the processor further comprises software that when executed utilizes the operating characteristic to determine the surface card, determines the downhole card, and generates a graphics signal representative of the surface card and the downhole card. The system finally includes an output system in communication with the processor, which upon receipt of the graphics signal from the processor provides a viewable graphical representation of both the surface card and the downhole card, wherein for the viewable graphical representation an axis on the surface card representing position is at the same scale as an axis on the downhole card representing position.

According to another embodiment of the present invention, there is provided a method of monitoring a reciprocating pump producing hydrocarbons from a wellbore extending from the surface into the subterranean. The method includes monitoring an operating characteristic of the well at the surface. The method also includes generating a surface card utilizing the operating characteristic. The method even also includes generating a downhole card, and finally includes generating a viewable graphical representation of both the surface card and the downhole card, wherein for the viewable graphical representation an axis on the surface card representing position is at the same scale as an axis on the downhole card representing position.

According to even another embodiment of the present invention, there is provided a system for monitoring a reciprocating pump producing hydrocarbons from a wellbore extending from the surface into the subterranean. The system generally includes a computer receiving data regarding an operating characteristic of the pump, and comprising software that when executed instruct the system to: generate a surface card utilizing the operating characteristic; generate a downhole card; and generate a viewable graphical representation of both the surface card and the downhole card, wherein for the viewable graphical representation an axis on the surface card representing position is at the same scale as an axis on the downhole card representing position.

According to still another embodiment of the present invention, there is provided a computer-readable storage medium having stored thereon a plurality of instructions for monitoring a reciprocating pump producing hydrocarbons from a wellbore extending from the surface into the subterranean. The instructions when executed by a computer instruct the computer to: generate a surface card utilizing an operating characteristic of the pump; generate a downhole card; and generate a viewable graphical representation of both the surface card and the downhole card, wherein for the viewable graphical representation an axis on the surface card representing position is at the same scale as an axis on the downhole card representing position.

According to yet another embodiment of the present invention, there is provided a propagated signal comprising a plurality of instructions for monitoring a reciprocating pump producing hydrocarbons from a wellbore extending from the surface into the subterranean. The instructions when executed by a computer instruct the computer to: generate a surface card utilizing an operating characteristic of the pump; generate a downhole card; and generate a viewable graphical representation of both the surface card and the downhole card, wherein for the viewable graphical representation an axis on the surface card representing position is at the same scale as an axis on the downhole card representing position.

According to even still another embodiment of the present invention, there is provided a system for monitoring a reciprocating pump producing hydrocarbons from a wellbore extending from the surface into the subterranean. The system generally includes a data gathering system to monitor a surface operating characteristic of the pumping system. The system also includes a database of ideal downhole cards. The system even also includes a processor in communication with the data gathering system and the database, wherein the processor comprises software that when executed utilizes the operating characteristic to determine the surface card, determines the downhole card, and generates a graphics signal representative of the surface card and the downhole card, and wherein the processor further comprises software that when executed makes a comparison of the downhole card against the database and generates a comparison signal dependent upon the comparison. The system finally includes an output system in communication with the processor, which upon receipt of the graphics signal from the processor provides a viewable graphical representation of both the surface card and the downhole card, wherein for the viewable graphical representation an axis on the surface card representing position is at the same scale as an axis on the downhole card representing position.

According to even yet another embodiment of the present invention, there is provided a method of monitoring a reciprocating pump producing hydrocarbons from a wellbore extending from the surface into the subterranean. The method includes monitoring an operating characteristic of the well at the surface. The method also includes generating a surface card utilizing the operating characteristic. The method further includes generating a downhole card. The method finally includes comparing the downhole card to a database of ideal downhole cards, and generating a comparison signal based on the comparing.

According to still even another embodiment of the present invention, there is provided a system for monitoring a reciprocating pump producing hydrocarbons from a wellbore extending from the surface into the subterranean, the system comprising a computer receiving data regarding an operating characteristic of the pump, and comprising software. When executed, the software instructs the system to: generate a surface card utilizing the operating characteristic; generate a downhole card; compare the downhole card to a database of ideal downhole cards, and generating a comparison signal based on the comparing.

According to still yet another embodiment of the present invention, there is provided a computer-readable storage medium having stored thereon a plurality of instructions for monitoring a reciprocating pump producing hydrocarbons from a wellbore extending from the surface into the subterranean. The instruction when executed by a computer instruct the computer to: generate a surface card utilizing the operating characteristic; generate a downhole card; compare the downhole card to a database of ideal downhole cards, and generating a comparison signal based on the comparing.

According to yet even another embodiment of the present invention, there is provided a propagated signal comprising a plurality of instructions for monitoring a reciprocating pump producing hydrocarbons from a wellbore extending from the surface into the subterranean. The instruction when executed by a computer instruct the computer to: generate a surface card utilizing the operating characteristic; generate a downhole card; compare the downhole card to a database of ideal downhole cards, and generating a comparison signal based on the comparing.

BRIEF DESCRIPTION OF THE DRAWINGS

FIGS. 5A thru 5L show "ideal" downhole card shapes, with FIG. 5A representing a full pump, FIG. 5B representing tubing movement, FIG. 5C represeting fluid pound, FIG. 5D representing gas interference, FIG. 5E representing flowing well, rod part, or inoperative pump, FIG. 5F representing pump hitting up or down, FIG. 5G representing bent barrel or sticking pump, FIG. 5H representing worn plunger or traveling valve, FIG. 5I representing worn standing valve, FIG. 5J representing worn or split barrel, FIG. 5K representing fluid friction, and FIG. 5L representing drag friction.

DETAILED DESCRIPTION OF THE INVENTION

The present invention will be described by reference to the drawings.

Figure 1:
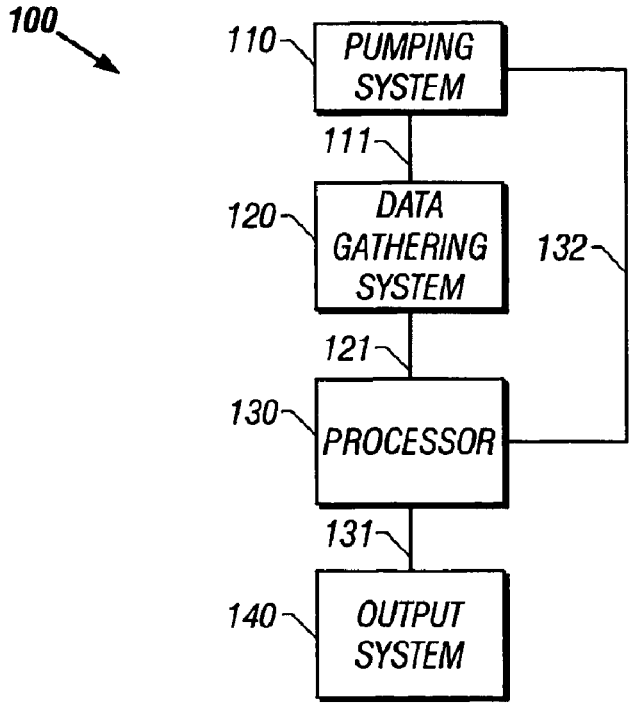
FIG. 1 is a schematic representation of well unit 100 of the present invention, including pumping system 110, data gathering system 120, processor 130, and output system 140.

Referring first to FIG. 1, there is shown a schematic representation of well unit 100 of the present invention, including pumping system 110, data gathering system 120, processor 130, and output system 140.

Data gathering system 120 is in communication with pumping system 110 and processor 130, by communication link 111 and communication link 121, respectively. Processor 130 is in communication with output system 140 by communication link 131, and optionally in communication with pumping system 110 by communication link 132. It should be understood that communication links 111, 121, 131 and 132 can be physical wire links or may be wireless links. These links may include one or more types of links, for example, phone line, network, Internet, and wireless.

It should also be understood that while data gathering system 120, processor 130, and output system 140 are shown as separate boxes in FIG. 1, any two, or perhaps all three can be incorporated into one physical unit. Additionally, pumping system 110, could also be configured to physically include one or more of these.

Pumping system 110 may be any suitable pumping system as is known in the art. While the present invention is shown illustrated in FIG. 2 with a conventional beam unit as pumping system 110, it should be understood that the present system should not be so limited and is intended to include but not be limited to any system that reciprocates a rod string, non-limiting examples of which include, tower type units which involve cables, belts, chains and hydraulic or pneumatic power systems. As another non-limiting example, rotating pumping systems, for example progressive cavity pumps, could also be utilized as pumping system 110.

Data gathering system 120 may be any suitable data gathering system for gathering the operating characteristic (s) of the pumping system necessary for determining the surface card. As described above, in the Background of the Invention, there are a number of different types of methods for determining the surface card, and each of these types of methods require the gathering of different operating characteristics. As non-limiting examples, one method requires monitoring of electric motor power consumption, another requires use of a strain gauge either located on the polish rod or on the beam of a beam pumping unit as an indicator of load, and even another utilizes temperature to differentiate between strain caused by load on the beam or metal and strain caused be changing temperature of the metal. Thus, data gathering system will include suitable apparatus for gathering the necessary operating characteristic required by the particular surface card method utilized.

Preferably, data gathering system 120 is not just temporarily gathering data from pumping system 110, as in a test, but rather gathers data from pumping system on a regular and on-going basis as part of the normal operations of pumping system 110.

Data gathering system 120 is considered to be permanently positioned and gathering data from pumping system on a regular and on-going basis as part of the normal operations of pumping system 110, in contrast to a one-time or merely short duration of data gathering with easily removable and portable data gathering equipment.

Processor 130 utilized in the present invention will be any processor suitable to produce the surface card and downhole card from the data provided by data gathering system 120. It should be understood that the present invention is not to be limited to any particular type of computer, but rather, processor 130 may be one or more processing systems including, but not limited to, a central processing unit (CPU), memory, storage devices, communication links, communication devices, servers, I/O devices, or any subcomponents or individual parts of one or more processing systems, including software, firmware, hardware or any combination or subcombination thereof, which embody the invention as set forth in the claims. User input may be received from the keyboard, mouse, pen, voice, touch screen, or any other means by which a human can input data to a computer, including through other programs such as application programs. One skilled in the art of computer science will easily be able to combine the software created as described with appropriate general purpose or special purpose computer hardware to create a computer system and/or computer subcomponents embodying the invention and to create a computer system and/or computer subcomponents for carrying out the method of the invention.

Optionally, processor 130 may generate signals 132 to either control pumping system 110 or to provide instructions to an operator of pumping system 110.

Like data gathering system 120, processor 130 is preferably not just temporarily processing data, as in a test, but rather receives and processes data from pumping system on a regular and on-going basis as part of the normal operations of pumping system 110.

Processor 130 is considered to be permanently positioned and processing data from pumping system on a regular and on-going basis as part of the normal operations of pumping system 110, in contrast to a one-time or merely short duration of data processing with easily removable and portable data processors.

Output system 140 includes any type of device or devices for producing a graphical representation of the surface and downhole cards viewable by the human eye, including but not limited to, a display screen, a projector, printer, holograph, and the like.

Like data gathering system 120 and processor 130, output system 140 is preferably not just temporarily providing viewable graphics, as in a test, but rather displays graphics on a regular and on-going basis as part of the normal operations of pumping system 110.

Output system 140 is considered to be permanently positioned and displaying data from pumping system on a regular and on-going basis as part of the normal operations of pumping system 110, in contrast to a one-time or merely short duration of data displaying with easily removable and portable output devices.

Figure 6:
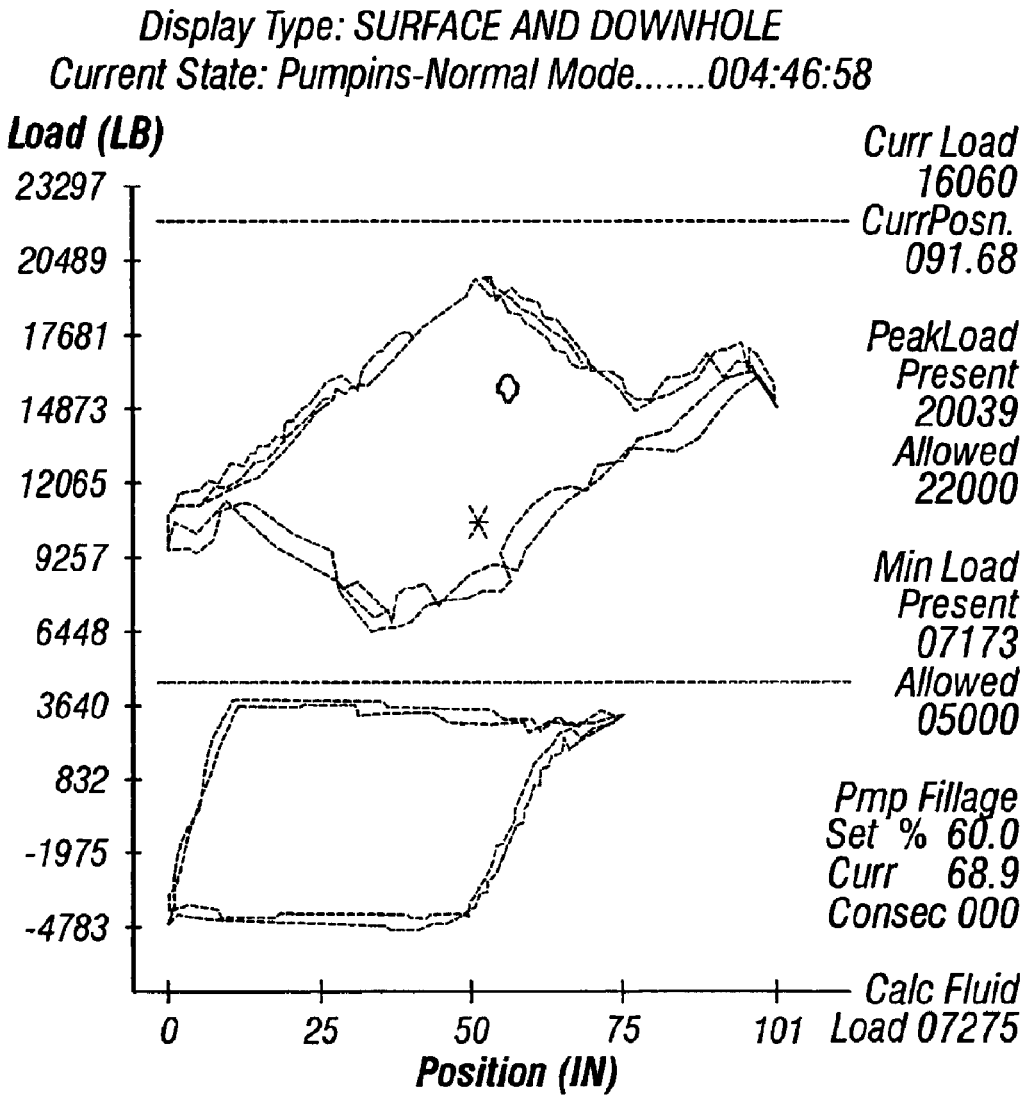
FIG. 6 illustrates a surface card and a downhole card representative of the operations of pumping unit displayed as an output system permanently positioned at the pump assembly, with a common position scale for the surface card and the pump card.

Output system 140 will also be suitable for receiving a graphical marker applied to the graphical displays of the surface and/or downhole cards. Referring now to FIG. 6, there is shown a plot of a surface card and a downhole card plotted on the same x-y axis, with the surface card positioned over the downhole card. One graphical marker, the "*" represents a pumpoff setpoint and the other graphical diamond is a malfunction setpoint. These are representative non-limiting examples of graphical markers that can be used to set control points or mark processor calculated indicators.

As one advantage of the present invention, graphical representations of the surface card and the downhole card are generated at the well site to provide for a more efficient well operation. Preferably, both the surface card and the downhole card are concurrently displayed either with both on the same screen, or with one each on two different screens.

As another advantage of the present invention, these well site generated representations of the surface card and the downhole card are provided with the same scale, thus allowing for direct comparisons between the cards. Preferably, the axis representing position (traditionally the x-axis or horizontal axis) is at the same scale for both the graphical representations of the surface card and the downhole card. More preferably, the axis representing position (traditionally the x-axis or horizontal axis) is at the same scale for both the graphical representations of the surface card and the downhole card, and the axis representing load on the rod (traditionally the y-axis or vertical axis) is at the same scale for both the graphical representations of the surface card and the downhole card.

As even another advantage of the present invention, these well site generated representations of the surface card and the downhole card are generated/updated in near real time. As used herein, "near real time" generally means within 24 hours of the data gathering, preferably within 12 hours of the data gathering, more preferably within 4 hours of the data gathering, even more preferably within 1 hour of the data gathering, still more preferably within 10 pump cycles or reciprocations (i.e., a pump cycle or reciprocation is one up and down stroke of the polished rod) of the data gathering, yet more preferably within 5 pump cycles of the data gathering, even still more preferably within 2 pump cycles of the data gathering, and even yet more preferably within 1 pump cycle of the data gathering.

Figure 2:
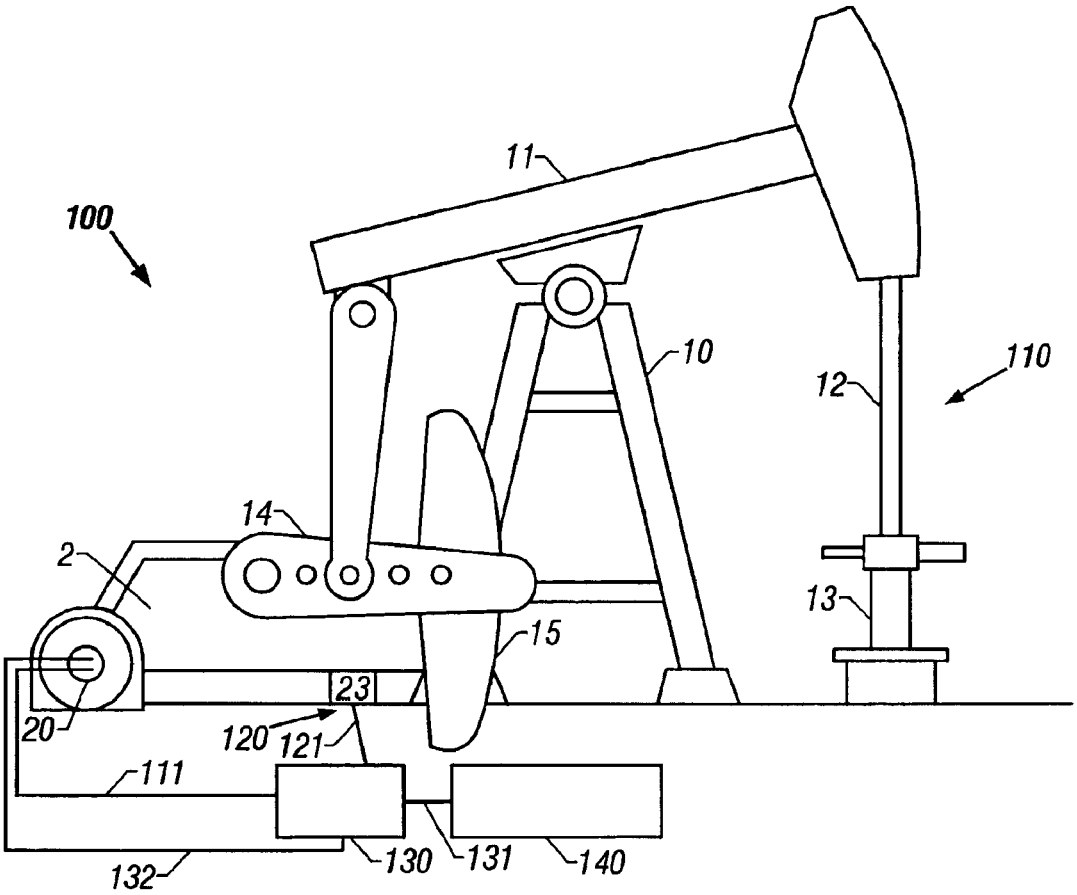
FIG. 2 is a schematic representation of one embodiment of well unit 100 of the present invention, including a conventional beam unit pumping system 110, data gathering system 120, processor 130, and output system 140.

Referring now to FIG. 2, there is shown one embodiment of well unit 100 of the present invention, including a conventional beam unit pumping system 110, data gathering system 120, processor 130, and output system 140.

Pumping unit 10 has a walking beam 11 which reciprocates a rod string 12 for actuating the downhole pump disposed at the bottom of well 13. The pump is a reciprocating type having a plunger attached to the end of the rod string and a barrel which is attached to the end of (or is part of) the production tubing in the well. The plunger has a traveling valve and a standing valve is positioned at the bottom of the barrel. On the upstroke of the pump, the traveling valve closes and lifts the fluid above the plunger to the top of the well and the standing valve opens and allows additional fluid from the reservoir to flow into the pump barrel. On the downstroke, the traveling valve opens while the standing valve closes allowing the fluid in the pump to pass upward through the plunger into the production tubing.

Walking beam 11 is reciprocated by crank arm 14 which is attached to walking beam 11. Crank arm 14 is provided with counterweight 15 that serves to balance the rod string that is also suspended from the walking beam. The crank arm 14 is driven by an electric motor 20 connected to a gear reduction 21.

Although the present invention is not so limited, the embodiment as shown utilizes the operating characteristic of instantaneous motor speed which is indicated as a signal 111 and as another operating characteristic the monitored position of the pumping unit to help determine when the well is pumped off. The position of the pumping unit can be detected by sensor 23 of data gathering system 120 which detects the passage of the crank 14 of the pumping unit. This sensing unit can be either magnetic or Hall effect type unit, or it could be a switch which is closed by the passage of the crank or counterweight. This embodiment can also be implemented with direct measuring position transducers.

The load and motor speed and crank sensor signals are supplied to processor 130, which then generates the surface card and downhole card. Display screen 140 provides a graphical representation of the surface card and downhole card concurrently, to the same scale, and in near real time. Optionally, processor 130 can generate a signal 132 to provide control to motor 20, depending upon the surface card and the downhole card.

Figure 3:
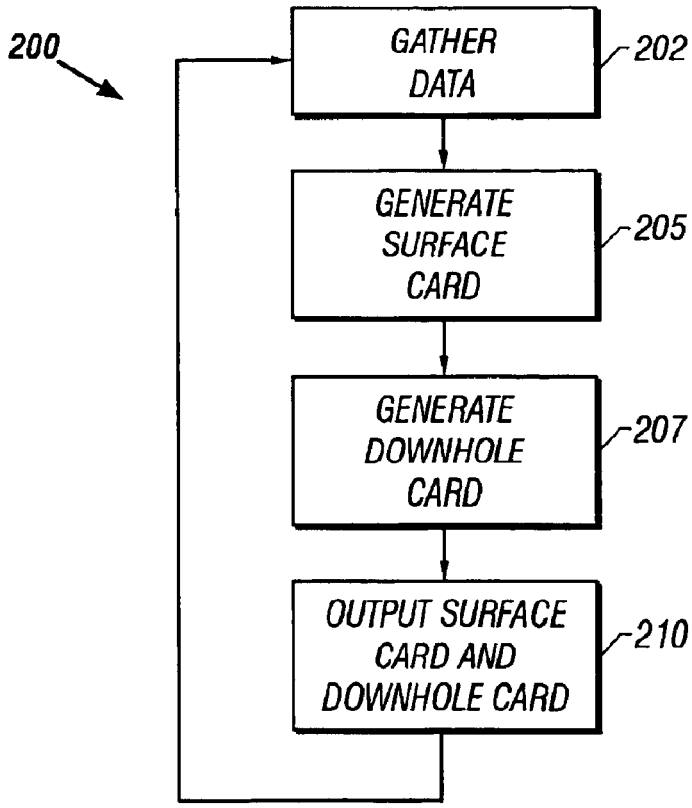
FIG. 3 is a schematic representation of one monitoring method 200 of the present invention, showing step 202 of gathering the data necessary to generate the surface card; step 205 of generating the surface card; and step 207 of generating the downhole card, and step 210 of outputting the surface and downhole cards.

Referring now to FIG. 3, there is provided a schematic representation of one monitoring method 200 of the present invention. This monitoring method 200 generally includes one or more of the following steps: step 202 of gathering the operating characteristic(s) necessary to generate the surface card; step 205 of generating the surface card; and step 207 of generating the downhole card, and output step 210 of outputting the surface and downhole cards.

Figure 4:
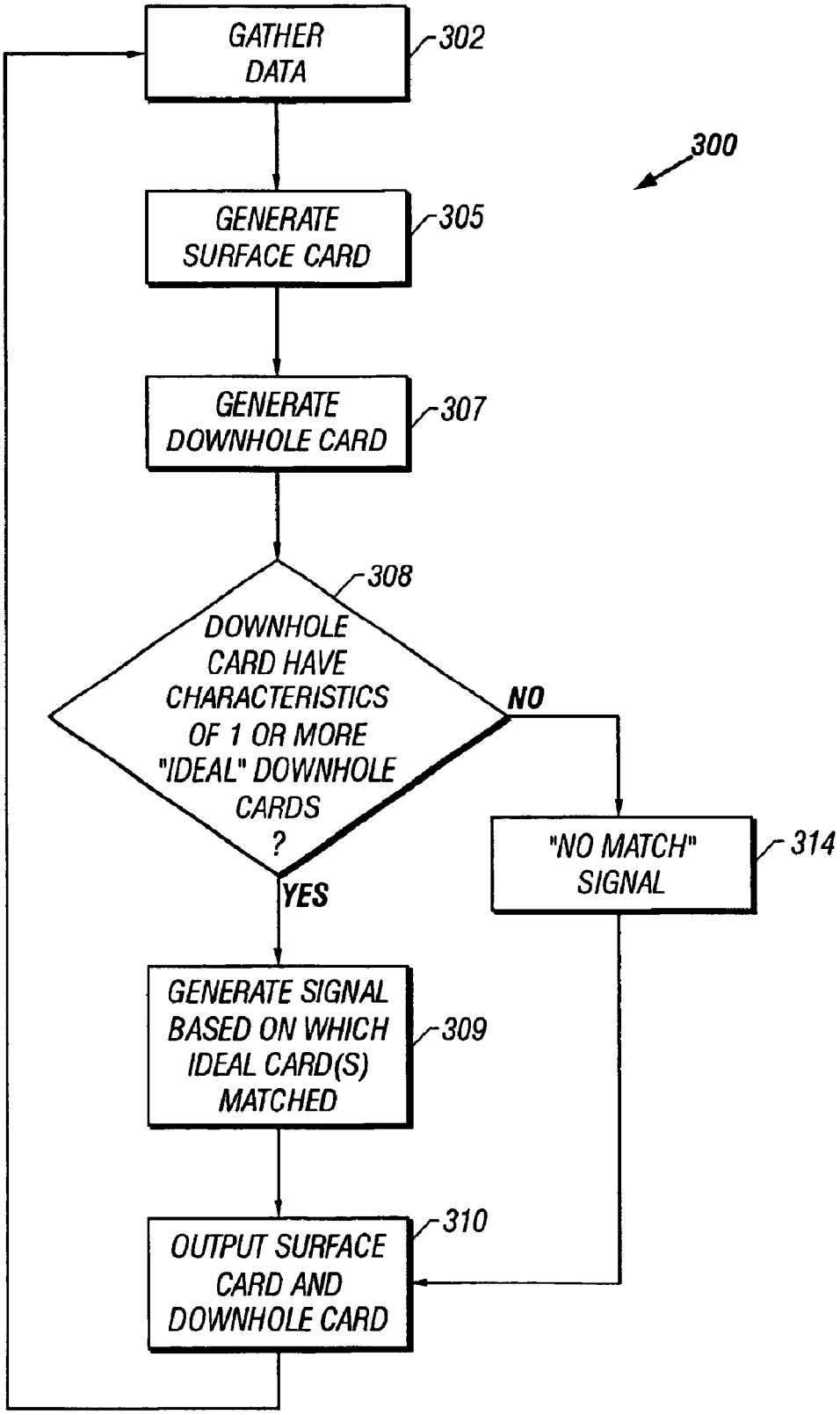
FIG. 4 is a schematic representation of one control method 300 of the present invention, showing step 302 for gathering the data necessary to generate the surface card, step 305 for generating the surface card, step 307 for generating the downhole card, comparison step 308 for matching the downhole card with "ideal" downhole cards, step 314 for generating a "no match signal" if there is no match, step 309 for generating a signal based on which ideal card or combination of cards were matched, and output step 310 includes outputting the surface and downhole cards.

Referring now to FIG. 4, there is shown a schematic representation of one control method 300 of the present invention. This controlling method 300 generally includes one or more of the following steps. Step 302 includes gathering the operating characteristic(s) necessary to generate the surface card, step 305 includes generating the surface card, and step 307 includes generating the downhole card. Next, comparison step 308 includes matching the downhole card with "idea" downhole cards, if there is no match, step 314 includes generating a "no match" indication, and if there is a match, signal step 309 includes generating a signal based on which ideal card or combination of cards were matched. Finally, output step 310 includes outputting the surface and downhole cards.

Optionally, the output steps of both monitoring method 200 (i.e., step 210) and of controlling method 300 (i.e., step 310), may include generating graphical representations of the surface card and the downhole card at the well site to provide for a more efficient well operation.

Also optionally, the output steps of both monitoring method 200 (i.e., step 210) and of controlling method 300 (i.e., step 310), may include concurrently displaying the surface card and the downhole card at the well site, either with both on the same screen, or with one each on two different screens.

Even also optionally, the output steps of both monitoring method 200 (i.e., step 210) and of controlling method 300 (i.e., step 310), may include generating well site representations of the surface card and the downhole card to the same scale, thus allowing for direct comparisons between the cards.

Still also optionally, the output steps of both monitoring method 200 (i.e., step 210) and of controlling method 300 (i.e., step 310), may include generating/updating these well site generated representations of the surface card and the downhole card in near real time.

For comparison step 308 of controlling method 300, the downhole card is matched against "ideal" downhole cards. This matching may be accomplished by any manner as known to those of skill in the art, non-limiting examples of which include numerically or by pattern recognition. Non-limiting examples of "ideal" downhole cards are shown in FIGS. 5A thru 5L, with FIG. 5A representing a full pump, FIG. 5B representing tubing movement, FIG. 5C represeting fluid pound, FIG. 5D representing gas interference, FIG. 5E representing flowing well, rod part, or inoperative pump, FIG. 5F representing pump hitting up or down, FIG. 5G representing bent barrel or sticking pump, FIG. 5H representing worn plunger or traveling valve, FIG. 5I representing worn standing valve, FIG. 5J representing worn or split barrel, FIG. 5K representing fluid friction, and FIG. 5L representing drag friction. It should be noted that a downhole card can match one of the ideal downhole cards, or have characteristics of a combination of the ideal downhole cards.

Signal generating step 309 will generate a signal based on the which ideal card or combination of cards was matched. This signal may be an instruction to a human operator or it may be an instruction provided directly to well 100.

For example, if the downhole card matches:

FIG. 5A representing a full pump, then the pump is operating at ideal;

FIG. 5B representing tubing movement, then the tubing needs to be anchored;

FIG. 5C represeting fluid pound, then the pumping speed needs to be reduced, or temporarily stopped;

FIG. 5D representing gas interference, then slow down pumping speed, or utilize an alternative means to separate gas downhole;

FIG. 5E representing flowing well, rod part, or inoperative pump, then turn pump off, and either allow flow (if there is flow), or repair part if necessary;

FIG. 5F representing pump hitting up or down, then respace the pump because the standing valve or traveling valve are tagging;

FIG. 5G representing bent barrel or sticking pump, then repair pump;

FIG. 5H representing worn plunger or traveling valve, then pull pump;

FIG. 5I representing worn standing valve, then pull pump;

FIG. 5J representing worn or split barrel, then pull pump;

FIG. 5K representing fluid friction, then there is either stuffing box friction, rod with paraffin buildup, or trash in the pump; and FIG. 5L representing drag friction, then the rods are dragging on tubing and rod guides are needed.

The product of the present invention includes computer readable media comprising instructions, or a data signal embodied in a carrier wave comprising instructions, said instructions which when carried out on a computer will implement one or more of the method steps of the present invention.

Using the foregoing specification, part or all of the present invention may be implemented using standard programming and/or engineering techniques using computer programming software, firmware, hardware or any combination or sub-combination thereof. Any such resulting program(s), having computer readable program code means, may be embodied or provided within one or more computer readable or usable media such as fixed (hard) drives, disk, diskettes, optical disks, magnetic tape, semiconductor memories such as read-only memory (ROM), etc., or any transmitting/receiving medium such as the Internet or other communication network or link, thereby making a computer program product, i.e., an article of manufacture, according to the invention. The article of manufacture containing the computer programming code may be made and/or used by executing the code directly from one medium, by copying the code from one medium to another medium, or by transmitting the code over a network.

All of the patents and articles cited herein, are herein incorporated by reference for all that they disclose and suggest, including but not limited to, methods and apparatus for gathering data, determining the surface card, determining the downhole card, and as relating to the well units themselves.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A system for controlling and monitoring a reciprocal pump (110) producing hydrocarbons from a wellbore extending from the surface into the subterranean, the system comprising:

(A) a data gathering system to generate a signal representative of a surface operating characteristic of the pumping system;

(B) a processor (130) in communication with the data gathering system, wherein the processor includes software that when executed utilizes the signal representative of the operating characteristic to determine a surface card, to determine a downhole card, and to generate a graphics signal (131) representative of at least one card of the surface card and the downhole card, and wherein the processor further comprises software that utilizes said least one card for generating a pump control signal (132); and (C) a permanently installed output system (140) at said processor and in communication with the processor, which upon receipt of the graphics signal from the processor provides a viewable graphical representation of said surface card and said downhole card on a regular and on-going basis as part of the normal operations of the system, wherein for the viewable graphical representation an axis on the surface card representing position is at a same scale as an axis on the downhole card representing position.

2. The system of claim 1, wherein the pump control signal (132) is provided directly or indirectly to the pump for automatic control of the pump or provided to a human operator for human control of the pump.

3. The system of claim 1, wherein the graphics signal (131) generated by the processor is representative of both the surface card and the downhole card.

4. The system of claim 3, wherein said surface card and said downhole card are presented on common x-y axes representing rod (12) load and position.

5. The system for controlling and monitoring of claim 4, wherein said pump control signal is generated in real time within 12 hours of generating said signal representative of said surface operating characteristics.

6. The system for controlling and monitoring of claim 4, wherein said pump control signal is generated in real time within two cycles of the pump after generating said signal representative of said surface operating characteristics.

7. A method of monitoring a reciprocating pump (110) producing hydrocarbons from a wellbore extending from the surface into the subterranean, the method comprising the steps of:

(A) producing a signal representative of an operating characteristic of the well at the surface;

(B) generating a downhole card utilizing the signal representative of said operating characteristic;

(C) displaying a viewable graphical representation of said downhole card on an output system (140) which is permanently positioned in association with said pump (110) on a regular and on-going basis as a part of a normal operation of the method.

8. The method of claim 7, further comprising the step of (D) generating a pump control signal in response to a characteristic of said downhole card.

9. The method of claim 8, wherein said steps (C) and (D) occur within twenty-four hours of said step (A) of monitoring said signal representative of an operating characteristic.

10. The method of claim 8, wherein said steps (C) and (D) occur within 10 reciprocations of the pump (110) after said step (A) of monitoring said signal representative of an operating characteristic.

11. The method of claim 8, wherein said steps (C) and (D) occur within 1 reciprocation of the pump (110) after said step (A) of monitoring said signal representative of an operating characteristic.

12. The method of claim 8, further comprising the step of, (E) providing the control signal directly or indirectly to the pump.

13. The method of claim 12, in which step (D) includes the step of comparing a shape of said downhole card to a shape of an ideal downhole card that is representative of an operating condition of the pump.

14. The method of claim 13, further comprising:

(F) cyclically performing the steps (A), (B), (C), (D), and (E) while said pump is reciprocating.

15. A system for controlling and monitoring a reciprocating pump producing hydrocarbons from a wellbore extending from the surface into the subterranean, the system of comprising, a computer arranged and designed to receive data regarding an operating characteristic of the pump, the computer including software that when executed instructs the system to perform the steps of:

(A) monitor a signal representative of an operating characteristic of the well at the surface;

(B) generate a surface card and a downhole card utilizing the operating characteristic;

(C) generate a pump control signal based on a characteristic of said downhole card; and (D) provide a viewable graphical representation of said surface card and said downhole card on a permanently positioned output system of the computer on a regular and on-going basis as part of the normal operations of the system, wherein for the viewable graphical representation an axis on the surface card representing position is at a same scale as an axis on the downhole card representing position.

16. The system of claim 15, wherein instructions (C) and (D) occur in near real time, relative to instruction (A) of monitoring said signal representative of an operating characteristic.

17. The system of claim 16, wherein near real time comprises within 24 hours.

18. The system of claim 16, wherein in near real time comprises within 10 reciprocations of the pump.

19. The system of claim 16, wherein in near real time comprises within 1 reciprocations of the pump.

20. The system of claim 15, wherein said software that when executed further instructs the system to:

(E) provide the pump control signal directly or indirectly to the pump.

21. The system of claim 15, in which instruction (C) generates said pump control signal by comparing a shape of said downhole card to a shape of an ideal downhole card that is representative of an operating condition of the pump.

22. The system of claim 21, where said software that when executed further instructs the system to:

(F) cyclically perform said steps (A), (B), (C), (D) of claim 15, and (E) of claim 20.

23. A system for monitoring a reciprocating pump producing hydrocarbons from a wellbore extending from the surface into the subterranean, the system comprising:

(A) a data gathering system (120) to monitor a surface operating characteristic of the pumping system;

(B) a processor (130) in communication with the data gathering system, wherein the processor comprises software that when executed utilizes the operating characteristics to determine a surface card, determines a downhole card, and generates a graphics signal representative of the surface card and the downhole card; and (C) an output system permanently positioned at said processor and (140) in communication with the processor, which upon receipt of the graphics signal from the processor provides a viewable graphical representation of the graphics signal on a display screen on a regular basis as part of normal operations of the pump (110), wherein for the viewable graphical representation an axis on the surface card representing position is at a same scale as an axis on the downhole card representing position.

24. A method of monitoring a reciprocating pump producing hydrocarbons from a wellbore extending from the surface into the subterranean, the method comprising the steps of:

(A) monitoring an operating characteristic of the well at the surface;

(B) generating a surface card utilizing the operating characteristics;

(C) generating a downhole card based upon said surface card; and (D) generating on a display screen permanently positioned in proximity of said pump on a regular basis as part of normal operation of the pump (110) a viewable graphical representation of both the surface card and the downhole card, wherein for the viewable graphical representation an axis on the surface card representing position is at the same scale as an axis on the downhole card representing position.

25. The method of claim 24, wherein step (D) of generating a viewable graphical representation occurs in near real time, relative to step (A) of monitoring an operating characteristic.

26. The method of claim 25, wherein the near real time comprises within 24 hours.

27. The method of claim 25, wherein in near real time comprises within 10 reciprocations of the pump.

28. The method of claim 25, where in near real time comprises within 1 reciprocation of the pump.

29. The method of claim 24, further comprising:

(E) adjusting the operation of the pump if warranted based on the surface card and the downhole card.

30. The method of claim 29, in which step (E) first comprises comparing the downhole card to ideal downhole cards.

31. The method for monitoring of claim 29, further comprising:

(F) repeating steps (A), (B), (C), (D), and (E).

32. A system for monitoring a reciprocating pump producing hydrocarbons from a wellbore extending from the surface into the subterranean, the system comprising a computer receiving data regarding an operating characteristic of the pump, the computer including software that when executed instructs the system to:

(A) generate a surface card utilizing the operating characteristic;

(B) generate a downhole card based upon said operating characteristic; and (C) generate a viewable graphical representation of both the surface card and the downhole card on a display screen permanently placed in proximity to the pump, wherein for the viewable graphical representation an axis for the surface card representing position is at the same scale as an axis for the downhole card representing; position.

33. The system of claim 32, wherein instruction (C) to generate a viewable graphical representation occurs in near real time.

34. The system of claim 32, wherein in near real time comprises within 4 hours.

35. The system of claim 32, wherein in near real time comprises within 2 reciprocations of the pump.

36. The system of claim 32, wherein in near real time comprises within 1 reciprocation of the pump.

37. The system of claim 32, wherein said software further instructs the system to:

(D) generate a control signal to adjust the operation of the pump if warranted based on a characteristic of at least one card of said surface card and said downhole card.

38. The system of claim 37, in which said software generates said control signal by comparing the downhole card to at least one ideal downhole card.

39. The system of claim 37, wherein said software further instructs the system to:

(E) cyclically repeat said steps (A), (B), (C), and (D).

* * * * *